US008205548B2

(12) United States Patent
Yamashita et al.

(10) Patent No.: US 8,205,548 B2
(45) Date of Patent: Jun. 26, 2012

(54) METHOD OF WINDING UP TRANSFER FILM AND DEVICE FOR PERFORMING TRANSFER PRINTING ON PRINTED SHEETS OF PAPER

(75) Inventors: Toshio Yamashita, Ishikawa (JP); Katsushi Hirokawa, Hiroshima (JP); Takahiko Nakamura, Hiroshima (JP)

(73) Assignee: Ryobi Ltd., Hiroshima-ken (JP)

( * ) Notice: Subject to any disclaimer, the term of this patent is extended or adjusted under 35 U.S.C. 154(b) by 862 days.

(21) Appl. No.: 12/233,410

(22) Filed: Sep. 18, 2008

(65) Prior Publication Data

US 2009/0078137 A1 Mar. 26, 2009

(30) Foreign Application Priority Data

Sep. 20, 2007 (JP) ..... 2007-243809

(51) Int. Cl.
*B31F 1/07* (2006.01)
*B41F 7/02* (2006.01)

(52) U.S. Cl. ..... 101/32; 101/485; 101/486; 400/614; 400/619; 226/3; 226/15; 226/17; 242/534.1; 242/578

(58) Field of Classification Search ..... 101/32, 101/485, 486; 400/211, 212, 614, 619, 630, 400/631, 633; 226/18–20, 3, 15, 17; 242/578, 242/534, 534.1, 578.1
See application file for complete search history.

(56) References Cited

U.S. PATENT DOCUMENTS 2,281,965 A * 5/1942 Wylie ..... 242/534.1
3,570,735 A * 3/1971 Kurz ..... 226/3
3,727,816 A * 4/1973 Meneo ..... 26/75
3,759,456 A * 9/1973 Moneagle et al. ..... 242/534.1
3,912,193 A * 10/1975 Calvaer ..... 242/534.1
4,048,952 A * 9/1977 Peterson et al. ..... 118/673
4,077,579 A * 3/1978 Seleski et al. ..... 242/563.1
4,123,569 A * 10/1978 Peterson et al. ..... 427/141
4,288,275 A * 9/1981 Davis ..... 156/367
4,500,045 A * 2/1985 Whitaker et al. ..... 242/534.1
5,300,787 A * 4/1994 Schrauwen et al. ..... 250/548
5,465,129 A * 11/1995 Vaynshteyn ..... 396/412
5,942,077 A * 8/1999 Tang ..... 156/361
6,095,452 A * 8/2000 Leskinen ..... 242/534
6,121,987 A * 9/2000 Sasaki et al. ..... 347/176

(Continued)

FOREIGN PATENT DOCUMENTS

DE 69603202 T2 5/2000

(Continued)

*Primary Examiner* — Judy Nguyen
*Assistant Examiner* — David Banh
(74) *Attorney, Agent, or Firm* — The Webb Law Firm

(57) ABSTRACT

There is provided a method of winding up a transfer film and a device for performing transfer printing on printed sheets of paper, capable of eliminating the need to frequently replace the transfer film, thereby allowing the transfer film to be used over a prolonged time. According to the method of winding up a transfer film, the transfer film fed from a feed roll through a feed path is pressed onto a fed printed sheet to transfer patterns of the transfer film, and then the transfer film is wound up onto a windup roll through a windup path. During the rewind of the transfer film from the windup roll to the feed roll, a lateral position of the transfer film running along the feed path is detected, and the feed roll is moved in its axial direction to follow a lateral positional change of the transfer film.

1 Claim, 5 Drawing Sheets

U.S. PATENT DOCUMENTS

| | | | | |
|---|---|---|---|---|
| 6,918,560 | B2 * | 7/2005 | Arai | 242/533.7 |
| 2001/0014220 | A1 * | 8/2001 | Okado | 396/319 |
| 2001/0040097 | A1 * | 11/2001 | Arao et al. | 205/82 |
| 2002/0168205 | A1 * | 11/2002 | Suden et al. | 400/70 |
| 2006/0113421 | A1 * | 6/2006 | Gomes et al. | 242/538 |
| 2007/0144669 | A1 * | 6/2007 | Kikuchi et al. | 156/311 |
| 2007/0212490 | A1 * | 9/2007 | Preisner et al. | 427/288 |
| 2008/0068753 | A1 * | 3/2008 | Biskeborn et al. | 360/130.21 |
| 2009/0230588 | A1 * | 9/2009 | Itoh et al. | 264/241 |
| 2011/0000948 | A1 * | 1/2011 | Fuwa | 226/3 |

FOREIGN PATENT DOCUMENTS

| | | | |
|---|---|---|---|
| DE | 202006005296 | U1 | 6/2006 |
| JP | 2006315229 | | 11/2006 |

* cited by examiner

METHOD OF WINDING UP TRANSFER FILM AND DEVICE FOR PERFORMING TRANSFER PRINTING ON PRINTED SHEETS OF PAPER

CROSS REFERENCE TO RELATED APPLICATION

This application claims priority from Japanese Patent Application No. 2007-243809, which is incorporated herein by reference.

BACKGROUND OF THE INVENTION

1. Field of the Invention

The present invention relates to a technique of pressing a transfer film onto printed sheets of paper to transfer thereon gold foil, embossed patterns, hologram patterns, and the like, thereby to increase added value of the printed surfaces, and more particularly, to a method of winding up a transfer film that is capable of winding up the transfer film in a favorable manner as well as a device for performing transfer printing on printed sheets of paper.

2. Related Art

There is proposed a gloss finishing apparatus for providing added value to printed sheets of paper in the above-mentioned manner. The apparatus includes a varnishing unit that applies an ultraviolet curable resin varnish (also simply referred to as "a varnish") onto the printed sheets of paper printed in a printing unit and a hologram forming unit that presses a transfer film onto the printed sheets of paper varnished in the varnishing unit to transfer patterns of the transfer film thereon. The transfer film is an endless reel wound around a total of four guiding rollers, i.e., a pair of pressing rollers disposed at the lower end and a pair of guiding rollers disposed at the upper end (e.g., see Japanese Unexamined Patent Publication No. 2006-315229 (FIGS. 1 and 2)).

In the gloss finishing apparatus according to Japanese Unexamined Patent Publication No. 2006-315229, since the transfer film has an endless structure without ends, which means that the transfer film can be used only for the length corresponding to the length of feeding path that is configured by the four rollers. Thus, the transfer film is necessarily repeatedly used, and there is a disadvantage in that the transfer film may be damaged at an early stage, which necessitates transfer film to be changed frequently.

SUMMARY OF THE INVENTION

In order to overcome the foregoing problems, it is an object of the present invention to provide a method of winding up a transfer film and a device for performing transfer printing on printed sheets of paper, capable of eliminating need to frequently replace the transfer film thereby to allow the transfer film to be used over a long period of time in a favorable manner.

According to one aspect of the present invention, there is provided a method of winding up a transfer film, including: pressing onto a fed printed sheet of paper a transfer film fed from a feed roll through a feed path to transfer a pattern of the transfer film onto the printed sheet; winding up the transfer film onto a windup roll through a windup path; and rewinding the transfer film from the windup roll to the feed roll, wherein during the rewind, a lateral position of the transfer film running along the feed path is detected, and the feed roll is moved in its axial direction to the side that the lateral position of the transfer film has shifted to.

According to another aspect of the present invention, there is provided a device for performing transfer printing on a printed sheet of paper, including: a feed roll for feeding a transfer film to a fed printed sheet; a transfer section that presses onto the printed sheet the transfer film that has been fed from the feed roll through a feed path to transfer a pattern of the transfer film on the printed sheet; and a windup roll that takes up the transfer film that has been subjected to the transfer printing at the transfer section, through a windup path, and the device further including: a driving mechanism for rewinding, to the feed roll, the transfer film that has been fed from the feed roll and wound up on the windup roll, and causing the feed roll to move in the lateral directions of the transfer film; a position detecting part that detects a lateral position of the transfer film that is moving along the feed path during the rewind of the transfer film to the feed roll; and a controlling part that controls the driving mechanism in such a manner as to cause the feed roll to move to the side that the lateral position of the transfer film has shifted to, based on detected information from the position detecting part.

The transfer film that has been fed from the feed roll is wound up on the windup roll, so that the transfer film can be lengthened by increasing the number of winds of the transfer film on the feed roll, with a compactly configured device as compared with one in which the transfer film is endlessly wound. Moreover, the transfer film that has been wound up on the windup roll is rewound to the teed roll, whereby the transfer operation can be carried out with the transfer film fed again from the feed roll toward the windup roll. Also, it is possible to eliminate a troublesome work that the windup roll and the feed roll are switched in position when the transfer film that has been fed from the feed roll is all wound up on the windup roll, and the transfer film is wound on a guiding roll or the like disposed between the two rolls to be wound up from the windup roll to the feed roll. A lateral position of the transfer film that is running along the feed path is detected during the rewind of the transfer film toward to the feed roll, and in a case where the detected position has changed, the feed roll is moved to the side that the lateral position of the transfer film has shifted to, thereby allowing the take-up position on the feed roll with respect to the transfer film to be adjusted to approximately the same position in a constant manner.

The position detecting part may include a sensor that is movable integrally with the feed roll, and the sensor may be moved to follow an end of the transfer film along with the feed roll that is moved according to the change in lateral position of the transfer film.

The device may further include: a second position detecting part on the feed path, the second position detecting part detecting a lateral position of the transfer film while the transfer film is being fed from the feed roll; and a second controlling part that controls the driving mechanism to cause the feed roll to move to a side opposite the side that the lateral position of the transfer film has shifted to, based on detected information from the second position detecting part.

The device may further include: a second driving mechanism that causes the windup roll to move in the lateral direction of the transfer film; a position detecting part on the windup path, the position detecting part having an identical structure to that of the position detecting part; and a third controlling part that controls the second driving mechanism in such a manner that the windup roll is moved to the side that the lateral position of the transfer film has shifted to, based on detected information from the position detecting part.

The device may further include: a rotary roller between the feed roll and the second position detecting part, the rotary roller guiding the transfer film and being movable in the lateral direction of the transfer film; a change-over part that provides a switch between an interlock state and a non-interlock state, the rotary roller and the feed roll being integrally moved in the lateral direction of the transfer film in the interlock state, the rotary roller being released from the interlock and rendered immovable in the lateral direction of the transfer film in the non-interlock state; and a change-over controlling part that provides an electrical switch among the three controlling parts in such a manner that, when the change-over part is switched to the interlock state, the second controlling part and the third controlling part are activated, and when the change-over part is switched to the non-interlock state, the controlling part is activated.

The transfer film that has been fed from the feed roll is wound up on the windup roll, so that the transfer film can be lengthened with a compactly configured device as compared with one in which the transfer film is endlessly wound. Moreover, the transfer film that has been wound up on the windup roll is rewound onto the feed roll, and during the rewind, the transfer film can be wound up with the feed roll caused to follow the positional change in lateral movement of the transfer film, so that the take-up position on the feed roll with respect to the transfer film can be adjusted to approximately the same position at all times. Accordingly, there can be provided a method of winding up a transfer film and a device for performing transfer printing on printed sheets of paper, capable of eliminating the need to frequently replace the transfer film and the need to switch the two rolls at the same time, thereby allowing the transfer film to be used favorably over a prolonged period of time.

The second position detecting part is provided on the feed path to detect a lateral position of the transfer film while the feed roll is feeding the transfer film, and the second controlling part is provided to control the driving mechanism so as to cause the feed roll to move to the side opposite the side that the lateral position of the transfer film has shifted to, based on the detected information from the second position detecting part; therefore, even when the fed transfer film is displaced in the lateral direction, the displaced position of the transfer film can be forcedly corrected while being fed toward the windup roll, and the take-up can be smoothly carried out. Also, the transfer printing can be performed at proper positions.

The second driving mechanism is provided to cause the windup roll to move in the lateral direction of the transfer film, the position detecting part identical to the aforementioned one is also provided on the windup path, and the third controlling part is provided to control the second driving mechanism so as to cause the windup roll to move to the side that the lateral position of the transfer film has shifted to, based on the detected information from the position detecting part. Thus, the transfer film can be wound up favorably onto the windup roll with changes in lateral position of the transfer film absorbed in the windup roll that takes up the transfer film fed from the feed roll, through the movement of the windup roll following the lateral positional change of the transfer film.

The change-over part is provided to provide a switch between the interlock state in which the rotary roller and the feed roll are integrally moved in the lateral direction of the transfer film, and a non-interlock state in which the rotary roller is released from the interlock to be rendered immovable in the lateral direction of the transfer film. The change-over controlling part is provided to provide an electrical switch among the three controlling parts so that, when the change-over part is switched to the interlock state, the second controlling part and the third controlling part are activated, and when the change-over part is switched to the non-interlock state, the controlling part is activated. Hence, only with the turning of the change-over part, not only the interlock between the rotary roller and the feed roll can be switched over, but also the drive of the three controlling parts can be switched over, which contributes to improved operability.

BRIEF DESCRIPTION OF THE DRAWINGS

The above, and other objects, features and advantages of the present invention will become apparent from the detailed description thereof in conjunction with the accompanying drawings wherein.

DESCRIPTION OF THE PREFERRED EMBODIMENTS

Figure 1:
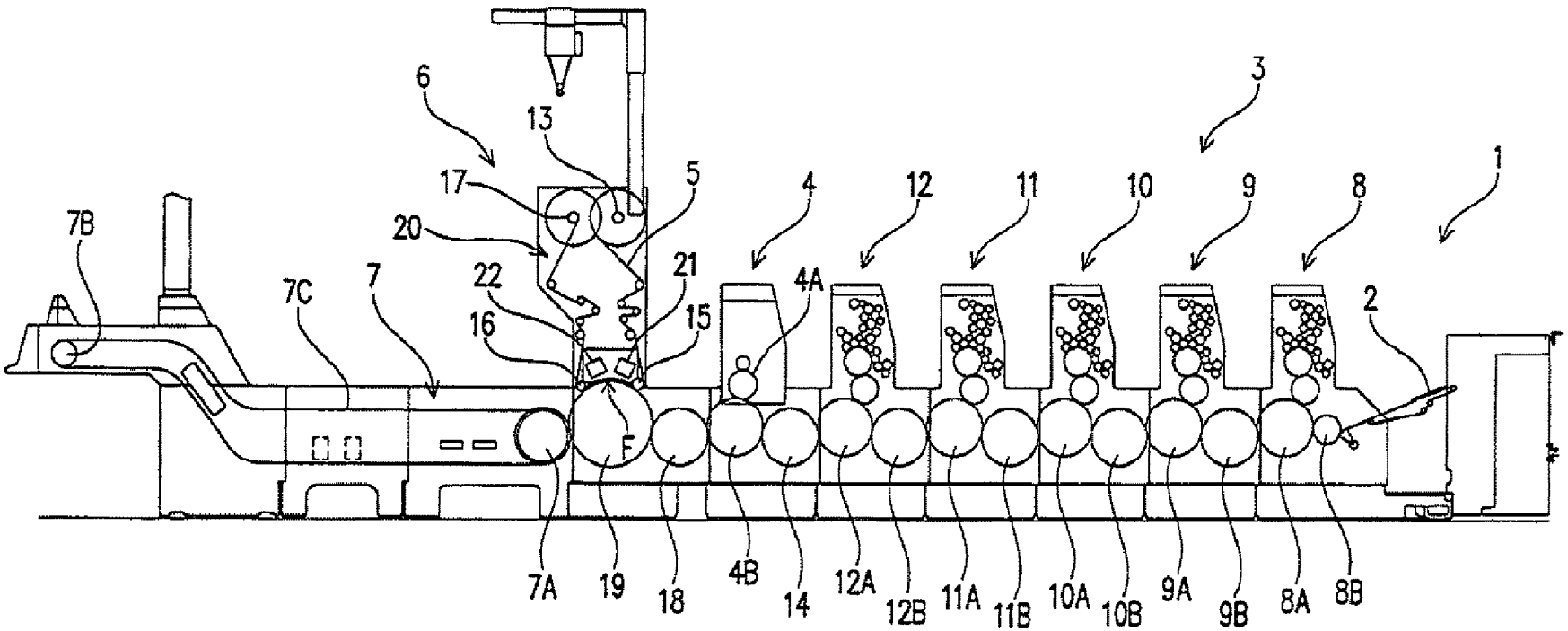
FIG. 1 is a schematic side view of a sheet-fed printing press.

FIG. 1 shows an example of a printing press incorporating a transfer device 6 capable of treating the printed surfaces of printed sheets of paper by varnishing and gloss-finishing the printed surfaces with a resin varnish and transferring thereon gold foil, embossed patterns, hologram patterns, and the like. This printing press includes a sheet feeder section 1, a printer section 3, a varnish applicator section 4, a transfer section F, and a sheet discharge section 7. The sheet feeder section 1 feeds sheets of paper 2 one sheet at a time by means of a feeder device, a sheet separator device, and the like from a sheet stack table. The printer section 3 performs five-color printing on the sheets 2 fed from the sheet feeder section 1. The varnish applicator section 4 applies (coats) an ultraviolet curable resin varnish (also simply referred to as "a varnish") onto the sheets 2 that have been printed in the printer section 3. The transfer section F presses a transfer film 5 made of a stretchable material with restoring force (e.g., polyethylene terephthalate, so-called PET; other materials may also be used), onto the ultraviolet curable resin varnish over the sheets 2 that have been applied with the ultraviolet curable resin varnish at the varnish applicator section 4, thereby treating the surfaces of the sheets 2. The sheet discharge section 7 discharges the sheets 2 whose surfaces have been treated at the transfer section F. Although the printer section 3 includes five printing units 8, 9, 10, 11, and 12 so that five-color printing can be performed in the present embodiment, the printer section may be one capable of printing other colors than five colors, such as a single color or more than one colors. In addition, while the sheet discharge section 7 is constructed of a chain conveyor device with grippers, the printing press may not include the sheet discharge section 7, and the specific structure of each section constituting the printing press is not limited to that shown in the figure. Also, while sheets of paper are used as the printed sheet herein, the printed sheet may be a continuous elongate sheet. Further, the transfer device 6 may be built in the printing press to be used therein, whilst the transfer device 6 may not be built in the printing press and may be used as a single independent unit.

In the case of attaching gold foil to the printed surfaces, a foil applicator called a toiler is used to press printed material, so that gold foil is peeled off from a substrate onto a portion with an adhesive material (or may be varnish) of the printed material attached thereto. The printed surfaces may also be applied with something other than gold foil.

Figure 2:
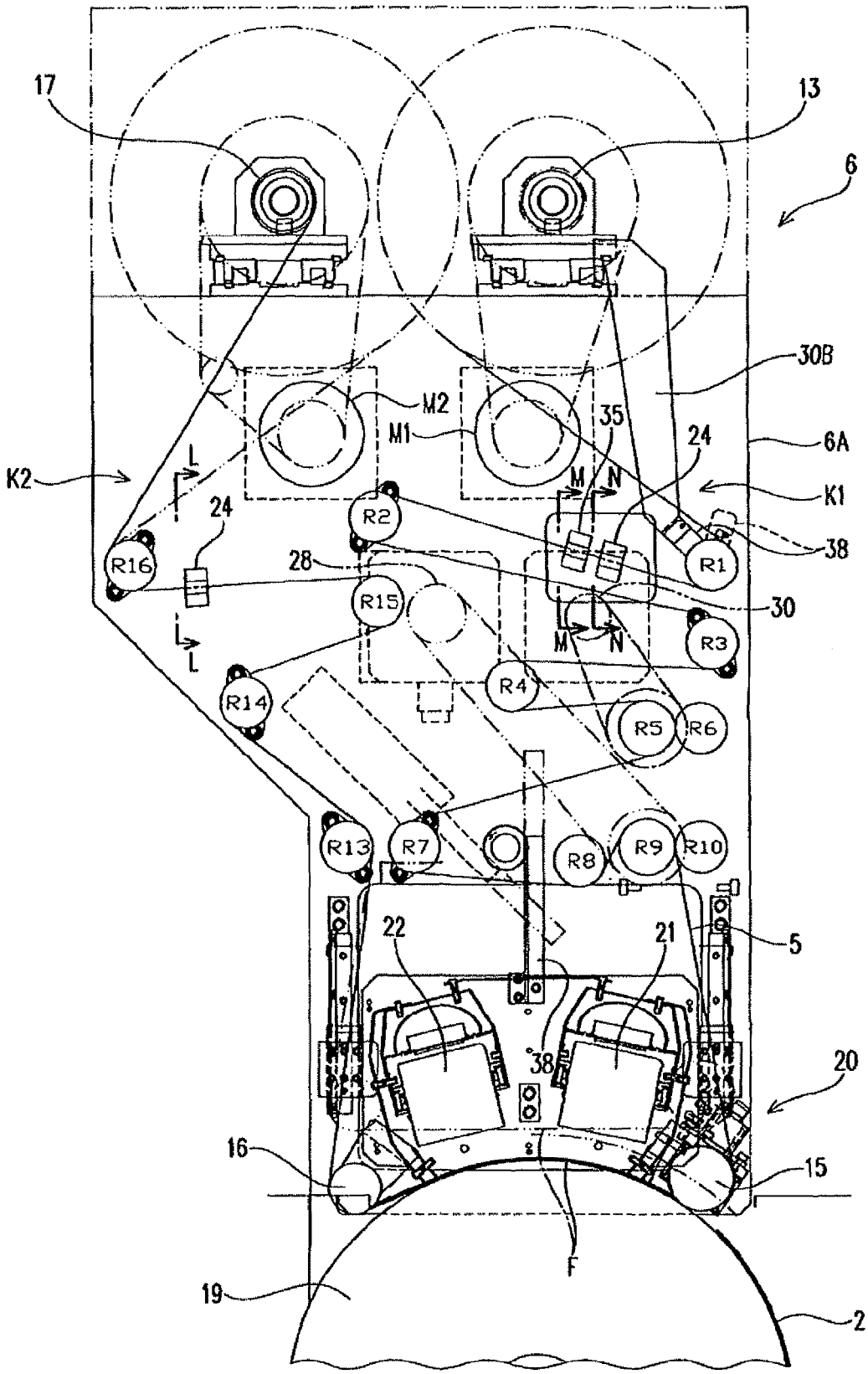
FIG. 2 is a side view of a transfer device.

The printing units 8 to 12 include, respectively, printing impression cylinders 8A to 12A as well as delivery cylinders 8B to 12B on the respective upstream sides of the printing impression cylinders 8A to 12A in a conveying direction, for delivering sheets 2 to the printing impression cylinders. The delivery cylinder 8B that has a smaller diameter and locates at the leading end in the conveying direction out of the delivery cylinders 8B to 12B is also referred to as a sheet feeder cylinder, and this delivery cylinder 8B, together with the feeder device, sheet separator device, and the like, constitutes the sheet feeder section 1. Although not shown in the figure, each of the impression cylinders 8A to 12A and the delivery cylinders 9B to 12B is provided with grippers, each having a jaw block and a gripping jaw to grip a fed sheet 2, at two positions (although only one position is shown in FIG. 2, one gripper may be provided at a single position or more than two grippers may be provided at more than two positions) in a circumferential direction. Although not shown, the delivery cylinder 8B of a smaller diameter is provided with a gripper having a jaw block and a gripping jaw to grip a sheet 2, at a single position in the circumferential direction. Also, the varnish applicator section 4 includes a varnishing cylinder 4A from which the ultraviolet curable resin varnish is supplied and an impression cylinder 4B that is located opposite to the varnishing cylinder 4A and coats the ultraviolet curable resin varnish over the printed sheets 2.

A delivery cylinder 14 is provided to deliver sheets 2 to the impression cylinder 4B. Although not shown, each of these cylinders 14 and 4B is also provided with grippers, each having a jaw block and a gripping jaw to grip a fed sheet 2, at two positions (one gripper may also be provided at a single position or more than two grippers may also be provided at more than two positions) in the circumferential direction, as with the above cylinders.

As shown in FIGS. 1 and 2, the transfer device 6 includes an impression cylinder 19 and a film transfer mechanism 20. The impression cylinder 19 receives sheets 2 from a delivery cylinder 18 that is provided to receive the sheets 2 from the impression cylinder 4B. The film transfer mechanism 20 presses the transfer film 5 onto the sheets 2 on the impression cylinder 19 to perform transfer printing thereon. The film transfer mechanism 20 is a processing means for processing sheets 2 and this film transfer mechanism 20 presses the transfer film 5 onto the sheets 2 to transfer gold foil, embossed patterns, hologram patterns, and the like from the transfer film 5 onto the sheets 2 while utilizing, as an adhesive agent, the ultraviolet curable resin varnish that has been applied at the varnish applicator section 4. The transfer film 5 is pressed onto the ultraviolet curable resin varnish over the sheets 2, so that the surfaces applied with the ultraviolet curable resin varnish can be smoothened and the surfaces are made even glossier. Then, ultraviolet irradiating lamps 21 and 22 (may be one or more than two) irradiate ultraviolet rays from above to the pressed film 5 to cure the ultraviolet curable resin varnish. The delivery cylinder 18 is also provided with grippers for gripping sheets 2 at two positions (one gripper may be provided at a single position or more than two grippers may be provided at more than two positions) in the circumferential direction, as with the above cylinders. The impression cylinder 19 is a so-called triple-diameter cylinder that has a larger diameter than the delivery cylinder 18 and is provided with grippers at three positions (not shown) in the circumferential direction, as with the above cylinders; therefore, the delivery cylinder 18 rotates 1.5 times while the impression cylinder 19 rotates a single time, whereby a sheet 2 can be passed to a gripper on the impression cylinder 19 from a gripper on the delivery cylinder 18 as described above. The impression cylinder 19 having a larger diameter (triple-diameter cylinder) than the other cylinders advantageously ensures a larger drying zone for the irradiation of ultraviolet rays as well as a longer distance from the varnish applicator section 4, but the impression cylinder 19 may have the same diameter as the other cylinders.

As shown in FIGS. 1 and 2, the transfer device 6 includes a feed roll 13, two (may be one or more than two) pressing rollers 15 and 16, and a windup roll 17. The feed roll 13 is capable of winding up the transfer film 5 as well as feeding the transfer film 5. The pressing rollers 15 and 16 press the transfer film 5 fed from the feed roll 13 onto the sheets (printed sheet) 2 on the impression cylinder 19. The windup roll 17 winds up the transfer film 5, which is peeled off from the printed sheets after being pressed by the pressing rollers 15 and 16. In FIG. 2, film guiding rollers R1 to R10 are disposed between the feed roll 13 and the pressing roller 15 on the upstream side in the conveying direction out of the two pressing rollers 15 and 16, namely, along a feed path K1. Film guiding rollers R13 to R16 are disposed between the pressing roller 16 on the downstream side in the conveying direction out of the two pressing rollers 15 and 16 and the windup roll 17, namely, along a windup path K2. The roller R4 is a tension roller that is provided on the feed side to apply predetermined tension. The roller R15 is a tension roller that is provided on the windup side to apply predetermined tension. The pressing roller 16 on the downstream side in the conveying direction is disposed at a position that is spaced upward from the impression cylinder 19 a set distance, because the film 5 can thereby be separated (peeled off) smoothly from the sheets 2; however, the pressing roller 16 may pressingly contact the impression cylinder 19. The feed roll 13 is rotatable driven with the power of an electric motor M1 for the feed roll, and the windup roll 17 is rotatably driven with the power of an electric motor M2 for the windup roll. While a total of four electric motors, i.e., the two electric motors M1 and M2 and two electric motors 28 and 30 for rotatably driving the drive rollers R9 and R5 on the feed path side, are basically operated in synchronization with one another, the rotation speeds of the electric motors, which sometimes cause loosening or excessive tension in the transfer film 5, are controlled so as to favorably eliminate such loosening or excessive tension.

As shown in FIG. 2, the two electric motors M1 and M2 are driven so as to rotate the feed roll 13 along with the windup roll 17 counterclockwise to cause the transfer film 5 to be fed from the feed roll 13 and taken up onto the windup roll 17, as well as to rotate the two rolls 13 and 17 clockwise to cause the transfer roll 5 that has been taken up on the windup roll 17 to be rewound onto the feed roll 13. In either case, the fed transfer film 5 can be taken up favorably. The configuration therefor is described below.

Figure 3A:
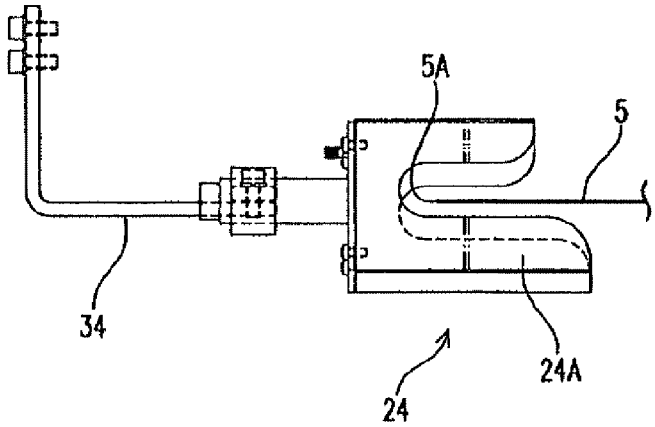
FIGS. 3A, 3B, and 3C are explanatory views showing positional relationships between each of three position detecting parts and a transfer film.
Figure 3B:
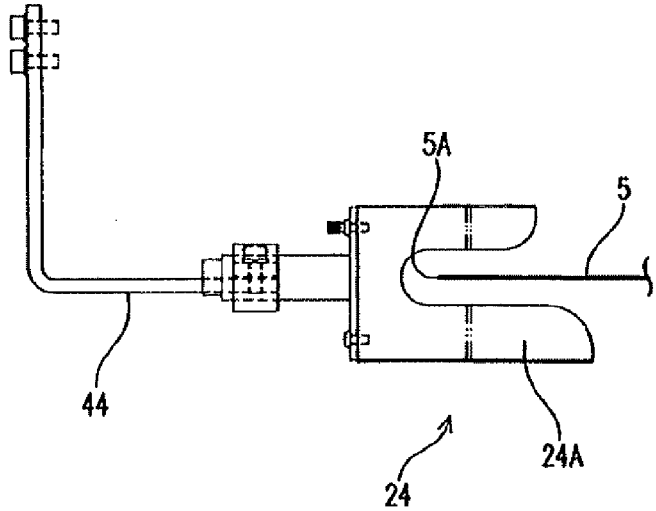
Figure 3C:
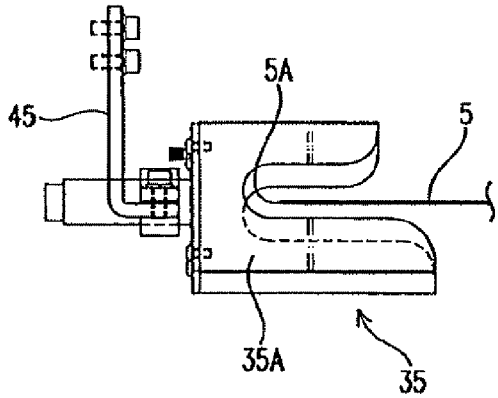
Figure 4:
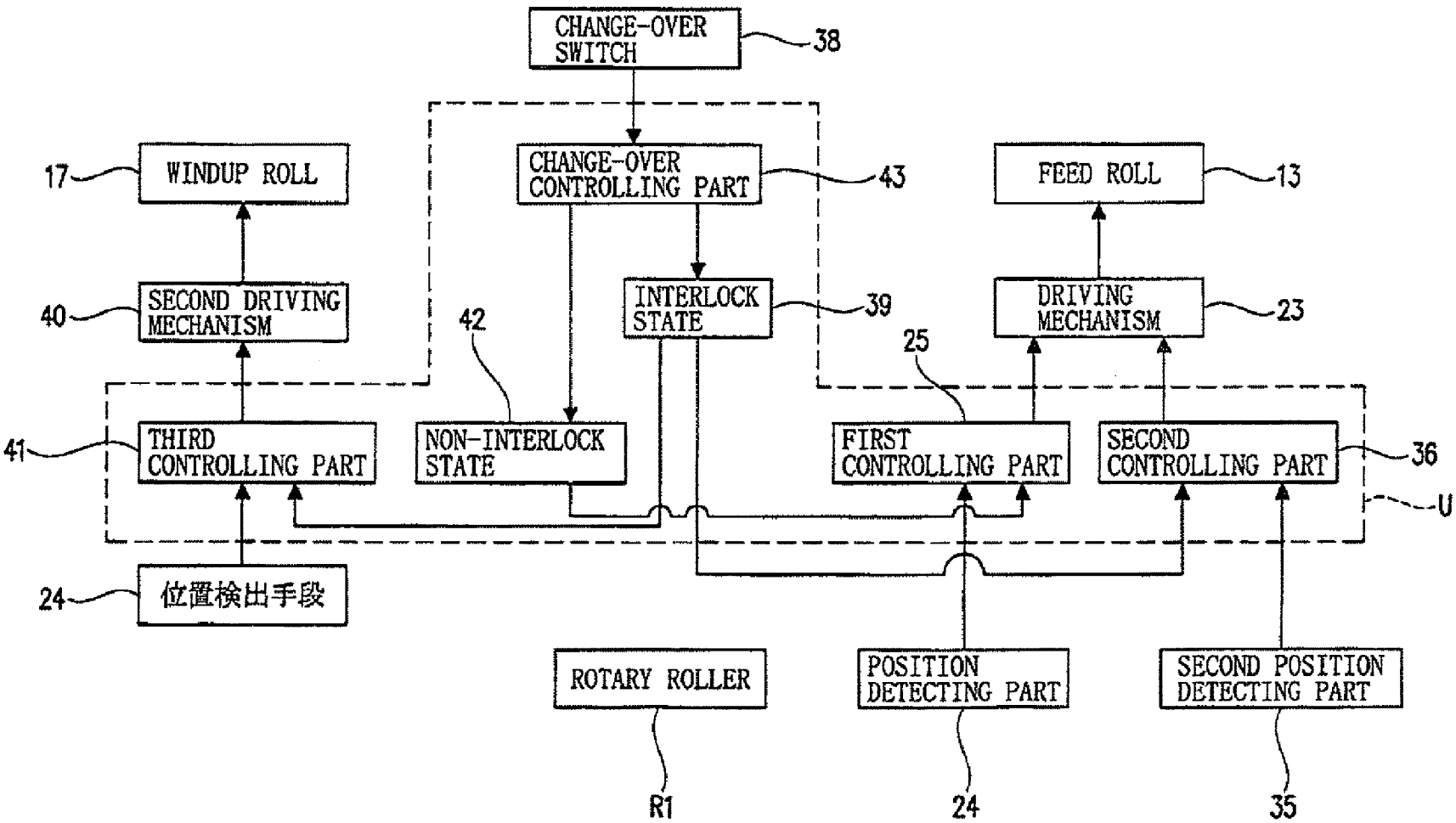
FIG. 4 is a control block diagram.

As shown in FIGS. 2 to 4, a driving mechanism 23 is provided to cause the feed roll 13 to move in the lateral directions of the transfer film 5. A position detecting part 24 is provided to detect a lateral position of the transfer film 5 that is moving along the feed path K1 during rewind of the transfer film 5 toward the feed roll. A controlling part 25 (to distinguish from a second controlling part to be described later, the controlling part 25 is referred to as a first controlling part) is provided to control the driving mechanism 23 so as to cause the feed roll 13 to move to the side that the lateral position of the transfer film 5 has shifted to, based on the detected information from the position detecting part 24.

Figure 5:
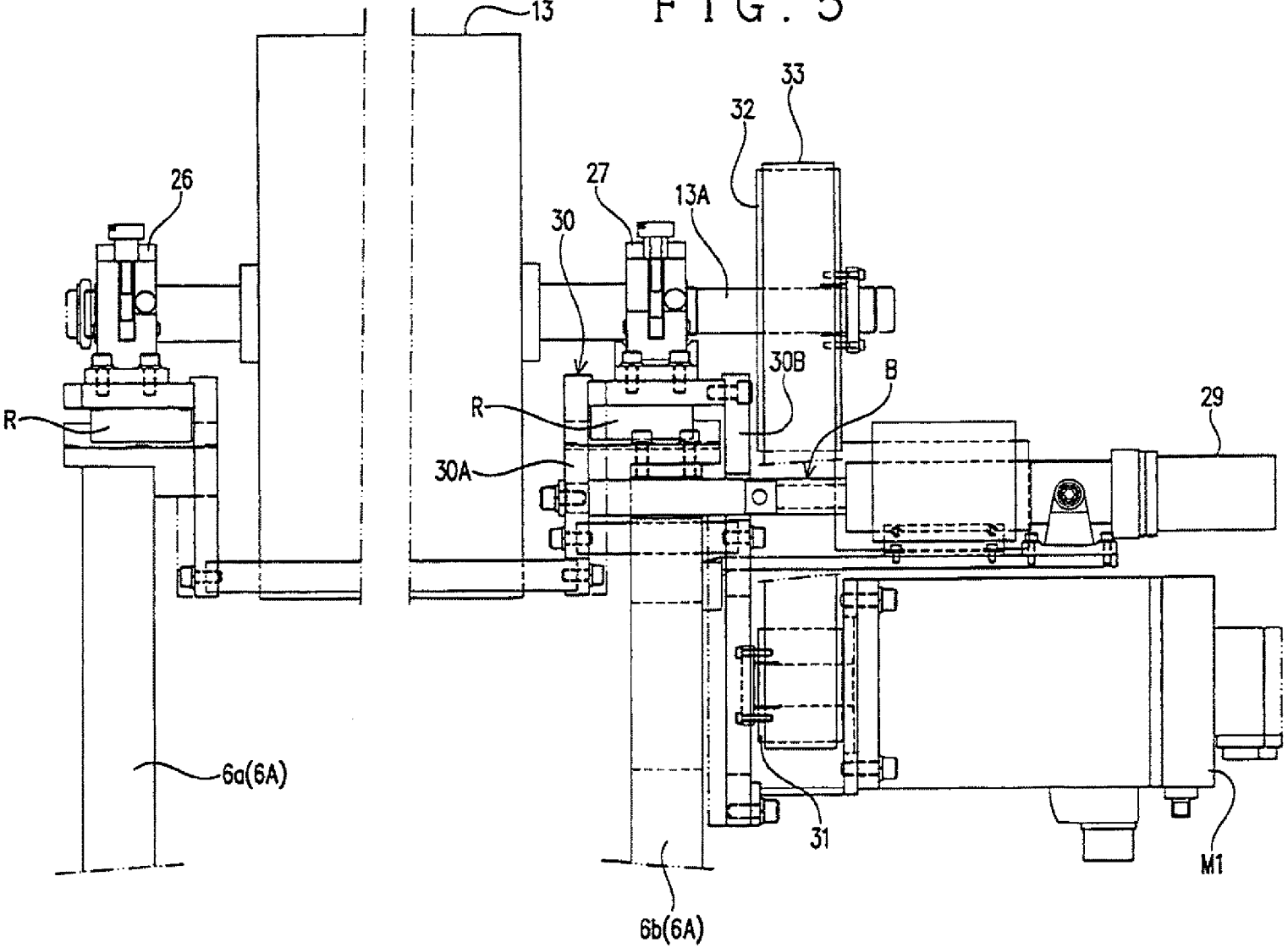
FIG. 5 is a front view showing a configuration for causing a feed roll to move in a lateral direction of the transfer film.

As shown in FIG. 5, the driving mechanism 23 includes support members 26 and 27, a ball thread B, and an electric motor 29. The support members 26 and 27 support a rotary shaft 13A of the feed roll 13 to a pair of sidewalls 6*a* and 6*b* constituting a casing 6A of the transfer device 6 so as to cause the rotary shaft 13A to move in its axial direction by means of a guide rail R. The ball thread 13 is provided for causing one 27 of the support members to move in the axial direction of the rotary shaft 13A. The electric motor 29 is fixed to the sidewall 6*b* so as to rotate the thread axis of the ball thread 13. The upper end of a gate-shaped member 30 provided with the guide rail R is fixed to the lower end of the support member 27. A first end of the ball thread B is coupled to a vertical wall 30A on the inner side of the sidewall 6*b* out of a pair of vertical walls 30A and 30B of the member 30. The electric motor M1 is fixed below the other 30B of the vertical walls. A belt 33 is wound around an output pulley 31 of the electric motor M1 and a pulley 32 that is fitted to a second end of the rotary shaft 13A of the feed roll 13 so as to be rotated integrally with the rotary shaft 13A.

The position detecting part 24 is an ultrasonic sensor that is coupled to the lower end of the vertical wall 30B by means of a bracket 34 shown in FIG. 3A so as to be movable integrally with the feed roll 13. The sensor 24 is movable following the edge 5A on an end of the transfer film 5, along with the feed roll 13 that is moved according to a change in lateral direction of the transfer film 5. The ultrasonic sensor 24 includes a transmitter (not shown) and a receiver (not shown). The transmitter is provided on an upper portion (or a lower portion) of an approximately U-shaped frame member 24A to transmit ultrasonic waves to the lower side (or the upper side). The receiver is provided on a lower portion (or an upper portion) of the frame member 24A to receive the transmitted ultrasonic waves. The transmitter and the receiver may alternatively be provided on the same side. When detection is made on an amount of attenuation of the ultrasonic waves that are transmitted from the transmitter and received at the receiver or on an interruption of the ultrasonic waves, it is determined that the edge 5A of the transfer film 5 has deviated from a predetermined position, whereupon the electric motor 29 is driven to cause the feed roll 13 to move in the direction in which the transfer film 5 has deviated. In this way, the ultrasonic sensor 24 is moved integrally therewith. Although the position of the edge 5A of the transfer film 5 is detected in the present embodiment, a detectable portion may be provided at a central position, not at the end, and the sensor 24 may be moved when it is detected that the detectable portion has deviated from a predetermined position. In this case, if the detectable portion is a mark or the like, an optoelectronic sensor or the like may be used besides the ultrasonic sensor.

As shown in FIG. 4, a second driving mechanism 40 is provided to cause the windup roll 17 to move in the lateral direction of the transfer film 5. As shown in FIG. 3B, a position detecting part 24 having an identical structure as the one described above is also provided on the windup path K2, and the position detecting part 24 is coupled on the side of the windup roll 17 by means of a bracket 44. A third controlling part 41 is provided to control the second driving mechanism 40 so as to cause the windup roll 17 to move in the direction following the change in position of the transfer film, based on the detected information from the position detecting part 24. In this case, the windup roll 17 and the position detecting part 24 are moved to the side that the transfer film 5 has shifted to, in line with the lateral movement of the transfer film 5 during the take-up of the fed transfer film 5 as described earlier.

As shown in FIG. 2, a second position detecting part 35 is provided on the feed path K1 to detect a lateral position of the transfer film 5 while the feed roll 13 is feeding the transfer film 5. As shown in FIG. 3C, the second position detecting part 35 is an ultrasonic sensor that is coupled to the stationary sidewall 6*a* by means of a bracket 45. The sensor detects a position of the edge 5A of an end of the transfer film 5A, and the feed roll 13 is moved in a direction opposite to the direction in which the position of the edge 5A has changed laterally, thereby correcting the position at which the transfer film 5 is fed to, e.g., the center in the lateral direction (any position will be employed as long as the position is set in advance). The ultrasonic sensor 35 includes a transmitter (not shown) and a receiver (not shown). The transmitter is provided on an upper portion (or a lower portion) of an approximately U-shaped frame member 35A to transmit ultrasonic waves to the lower side (or the upper side). The receiver is provided on a lower portion (or an upper portion) of the frame member 35A to receive the transmitted ultrasonic waves. When detection is made on an amount of attenuation of the ultrasonic waves that are transmitted from the transmitter and received at the receiver, or on an interruption of the ultrasonic waves, it is determined that the edge 5A of the transfer film 5 has deviated from a predetermined position. Upon the determination, the electric motor 29 is driven so as to cause the feed roll 13 to move against the direction in which the edge 5A has deviated, thereby locating the edge 5A of the transfer film 5 at the same position relative to the ultrasonic sensor 35 at all times. Although the position of the edge 5A of the transfer film 5 is detected in the present embodiment, a detectable portion may be provided in a central portion, not at the end, and detection may be made on the deviation of the detectable portion from a predetermined position so that the sensor 35 is caused to move. In this case, if the detectable portion is a mark or the like, an optoelectronic sensor or the like may be used besides the ultrasonic sensor.

More specifically, as shown in FIG. 4, a second controlling part 36 is provided to control the driving mechanism 23 so as to cause the feed roll 13 to move in a direction opposite to the direction in which the lateral position of the transfer film 5 has changed, based on the detected information from the second position detecting part 35. The rotary roller R1 is disposed between the feed roll 13 and the second position detecting part 35 to guide the transfer film 5. The rotary roller R1 is movable in the lateral direction of the transfer film 5.

A change-over switch 38 configuring a change-over part is provided to provide a switch between an interlock state 39 in which the rotary roller R1 and the feed roll 13 are integrally moved in the lateral direction of the transfer film 5 and a non-interlock state 42 in which the rotary roller R1 is released from the interlock to be rendered immovable in the lateral direction of the transfer film 5. A change-over controlling part 43 is provided to provide an electrical switch among the three controlling parts 25, 36, and 41 so that when the change-over switch 38 is switched to the interlock state 39, the second controlling part 36 and the third controlling part 41 are activated, whereas when the change-over switch 38 is switched to the non-interlock state 42, the first controlling part 25 is activated. As shown in FIG. 2, a proximate sensor (not shown) is provided to detect a changeover of the change-over switch 38 from a position shown with a dashed line to a position shown with a solid line. Accordingly, turning the change-over switch 38 to the position shown with the solid line brings the vertical wall 30B and the rotary roller R1 into a mechanically coupled state (the interlock state), and the proximate sensor outputs an ON signal to activate the second controlling part 36 and the third controlling part 41. Meanwhile, turning the change-over switch 38 to the position shown with the dashed line causes release from the interlock (the non-interlock state), and the proximate sensor outputs an OFF signal to activate the first controlling part 25. The change-over controlling part 43, the first controlling part 25, the second controlling part 36, and the third controlling part 41 are included in a controller U.

In short, in the windup step where the transfer film 5 is fed from the feed roll 13 and wound up onto the windup roll 17, the change-over switch 38 is turned to the position shown with the solid line in FIG. 2 to bring the vertical wall 30B and the rotary roller R1 into the mechanically coupled state (the interlock state), and the second position detecting part 35 detects a position of the transfer film 5 in the lateral direction. When it is detected that the position of the transfer film 5 has changed, the feed roll 13 and the rotary roller R1 are integrally moved to the side opposite to the side that the lateral position of the transfer film 5 has shifted to, thereby correcting the position of the transfer film 5 in the lateral direction when fed. On the windup side, the position detecting part 24 detects a position of the transfer film 5 in the lateral direction, and when it is detected that the position has changed, the windup roll 17 is caused to follow the lateral positional movement of the transfer film 5 while winding up the transfer film 5, so that the transfer film 5 can be taken up with the take-up position of the transfer film 5 with respect to the windup roll 17 adjusted to approximately the same position at all times. At this point, the position detecting part 24 moves integrally with the windup roll 17 to the same side.

In the rewind step where the transfer film 5 wound up on the windup roll 17 is rewound onto the feed roll 13, the change-over switch 38 is turned to the position shown with the dashed line in FIG. 2 to bring the feed roll 13 and the rotary roller R1 out of the mechanical interlock and the first controlling part 25 is activated. That is, the position detecting part 24 detects a position of the transfer film 5 in the lateral direction, and when it is detected that the position has changed, the feed roll 13 is caused to follow the lateral positional movement of the transfer film 5 while taking up the transfer film 5. At this point, the position detecting part 24 moves integrally with the feed roll 13 to the same side. It is possible to have the windup path K2 include the second position detecting part 35 and to add a configuration to correct the lateral position of the transfer film 5 fed from the windup roll 17 in a similar manner to the above. In this case, the rotary roller R16 is preferably moved integrally with the windup roll 17 in the axial direction of the windup roll 17. Further, although the present embodiment illustrates an example in which the mechanical interlock is made through manual operation using the change-over switch 38, an actuator and the like for automatically switching states of mechanical interlock may be used to choose operation modes, e.g., a transfer mode in which the transfer film 5 is fed from the feed roll 13 and wound up onto the windup roll 17, and a rewind mode in which the transfer film 5 that has been taken up on the windup roll 17 is rewound onto the feed roll 13 so that the changeover of the mechanical interlock and control can be automatically conducted at once by means of the feed roll 13.

As shown in FIG. 2, the transfer section F that is comprised of the pressing rollers 15 and 16 and the transfer film 5 carried between the pressing rollers 15 and 16 is movable away from (shown with a chain double-dashed line) or close to (shown with a solid line) the impression cylinder 19. While, e.g., the transfer operation is not performed, the transfer section F may be located at the upward-receded position.

The sheet discharge section 7 includes a conveyor device for receiving the sheets 2 that have been processed in the processing devices and conveyed thereto, and conveying them to a predetermined position. The conveyor device is provided over a pair of right and left endless running chains 7C that are suspended between a pair of right and left sprockets 7A and 7B respectively. Each of the sprockets 7A and 7B is provided with grippers at both ends in the sheet-conveying direction (although not shown, the basic structures thereof are the same as the above-described grippers) for gripping the sheets (see FIG. 1).

This specification is by no means intended to restrict the present invention to the preferred embodiments set forth therein. Various modifications to the method for winding up transfer film and device for performing transfer printing on printed sheets of paper, as described herein, may be made by those skilled in the art without departing from the spirit and scope of the present invention as defined in the appended claims.

What is claimed is:

1. A device for performing transfer printing on a printed sheet of paper, comprising:

a feed roll for feeding a transfer film to a fed printed sheet;

a transfer section that presses onto the printed sheet the transfer film that has been fed from the feed roll through a feed path to transfer a pattern of the transfer film on the printed sheet; and a windup roll that takes up the transfer film that has been subjected to the transfer printing at the transfer section, through a windup path:

a driving mechanism configured to be capable of rewinding, to the feed roll, the transfer film that has been fed from the feed roll and wound up on the windup roll, the driving mechanism causing the feed roll to move in the lateral directions of the transfer film;

a position detecting part that detects a lateral position of the transfer film that is moving along the feed path during the rewind of the transfer film to the feed roll;

a first controlling part that controls the driving mechanism in such a manner as to cause the feed roll to move to the side to which the lateral position of the transfer film has shifted, based on detected information from the position detecting part during the rewind of the transfer film to the feed roll, wherein the position detecting part includes a sensor that is movable integrally with the feed roll, and the sensor is moved to follow an end of the transfer film along with the feed roll that is moved according to the change in lateral position of the transfer film;

a second position detecting part on the feed path, the second position detecting part detecting a lateral position of the transfer film while the transfer film is being fed from the feed roll;

a second controlling part that controls the driving mechanism to cause the feed roll to move to a side opposite to the side to which the lateral position of the transfer film has shifted, based on detected information from the second position detecting part while the transfer film is being fed from the feed roll;

a second driving mechanism that causes the windup roll to move in the lateral direction of the transfer film;

a third position detecting part on the windup path, the third position detecting part detecting a lateral position of the transfer film while the transfer film fed from the feed roll is being wound up onto the windup roll;

a third controlling part that controls the second driving mechanism in such a manner that the windup roll is moved to the side to which the lateral position of the transfer film has shifted, based on detected information from the third position detecting part;

a rotary roller between the feed roll and the second position detecting part, the rotary roller guiding the transfer film and being movable in the lateral direction of the transfer film;

a change-over part that provides a switch between an interlock state and a non-interlock state, the rotary roller and the feed roll being moved integrally with each other in the lateral direction of the transfer film in the interlock state, the rotary roller being released from the interlock and rendered immovable in the lateral direction of the transfer film in the non-interlock state; and a change-over controlling part that provides an electrical switch among the three controlling parts in such a manner that, when the change-over part is switched to the interlock state, the second controlling part and the third controlling part are activated, and when the change-over part is switched to the non-interlock state, the first controlling part is activated.

* * * * *